US007574820B2

(12) United States Patent
Musso, Jr. et al.

(10) Patent No.: US 7,574,820 B2
(45) Date of Patent: Aug. 18, 2009

(54) JACK STAND FOR PLOW HITCH

(75) Inventors: Charles S. Musso, Jr., Hammondsport, NY (US); Tom W. Musso, Bath, NY (US); Brian Weaver, Prattsburgh, NY (US)

(73) Assignee: SP Fabricators, LLC, Prattsburgh, NY (US)

( * ) Notice: Subject to any disclaimer, the term of this patent is extended or adjusted under 35 U.S.C. 154(b) by 70 days.

(21) Appl. No.: 11/602,610

(22) Filed: Nov. 21, 2006

(65) Prior Publication Data

US 2008/0115391 A1 May 22, 2008

(51) Int. Cl.
*E01H 5/06* (2006.01)

(52) U.S. Cl. ..... 37/270; 37/231; 172/273

(58) Field of Classification Search ..... 37/270, 37/232, 231, 266, 263; 172/275, 684.5, 677–681; 280/475, 508, 511

See application file for complete search history.

(56) References Cited

U.S. PATENT DOCUMENTS 1,774,894 A * 9/1930 Land ..... 280/428
2,196,510 A * 4/1940 Wilhelm ..... 254/420
2,205,436 A * 6/1940 Richards ..... 254/420
2,225,157 A * 12/1940 Court ..... 280/764.1
2,361,304 A * 10/1944 Mappin ..... 172/274
2,474,483 A * 6/1949 Luttrell ..... 280/763.1
2,580,545 A * 1/1952 Hill ..... 280/475
2,628,126 A * 2/1953 Black ..... 298/5
2,672,318 A * 3/1954 Francis ..... 254/420
2,851,250 A * 9/1958 Hansen ..... 254/420
3,150,884 A * 9/1964 Drott ..... 280/460.1
3,167,327 A * 1/1965 Bumpious ..... 280/464
3,175,710 A * 3/1965 Kistner ..... 414/534
3,181,891 A * 5/1965 Moats ..... 280/475
3,281,160 A * 10/1966 Vinther et al. ..... 254/420
3,314,692 A * 4/1967 Karns ..... 280/475
3,362,683 A * 1/1968 Hansen ..... 254/423
3,405,955 A * 10/1968 Schuler ..... 280/475
3,425,714 A * 2/1969 Morris ..... 280/475
3,874,696 A * 4/1975 Gardner et al. ..... 254/419
4,113,274 A * 9/1978 Vahrenkamp ..... 280/475
4,118,054 A * 10/1978 Vigerie ..... 280/765.1
4,205,825 A * 6/1980 Stanford ..... 254/420

(Continued)

FOREIGN PATENT DOCUMENTS

DE 3604097 A1 * 8/1987

*Primary Examiner*—Thomas A Beach
(74) *Attorney, Agent, or Firm*—Alix, Yale & Ristas, LLP

(57) ABSTRACT

A jack assembly integrated with a plow hitch assembly includes a horizontally supported, rotatable jack tube and a jack leg extending from the tube, rotatable with the tube between a vertical, deployed position and a retracted position. An actuator has one end attached to the jack assembly and another end forming a handle projecting above the hitch frame, for rotating the jack assembly. The jack leg can be selectively extended and retracted relative to the tube when the jack assembly is deployed. A method embodiment includes lowering the plow to the ground while the hitch frame is mounted to the vehicle; rotating the jack assembly so the jack leg projects toward the ground; extending the jack leg to contact the ground; rigidly supporting the extended jack leg relative to the hitch frame; demounting the hitch frame from the vehicle; and driving the vehicle out of the hitch frame.

5 Claims, 13 Drawing Sheets

U.S. PATENT DOCUMENTS

| | | | | | |
|---|---|---|---|---|---|
| 4,275,984 | A | * | 6/1981 | Lenertz | 414/686 |
| 4,536,009 | A | * | 8/1985 | Ashworth | 280/755 |
| 4,556,200 | A | * | 12/1985 | Shoemaker | 254/424 |
| 4,711,428 | A | * | 12/1987 | Carpenter | 254/423 |
| 5,087,063 | A | * | 2/1992 | Merrill, Jr. | 280/475 |
| 5,217,209 | A | * | 6/1993 | Anders | 254/419 |
| 5,353,530 | A | | 10/1994 | Pieper | |
| 5,451,080 | A | * | 9/1995 | Kneile | 248/354.1 |
| RE35,700 | E | | 12/1997 | Watson et al. | |
| 5,894,688 | A | * | 4/1999 | Struck et al. | 37/271 |
| 6,151,808 | A | * | 11/2000 | Curtis | 37/234 |
| 6,354,024 | B1 | * | 3/2002 | Kost et al. | 37/231 |
| 6,393,737 | B2 | * | 5/2002 | Quenzi et al. | 37/231 |
| 6,408,546 | B2 | * | 6/2002 | Curtis | 37/231 |
| 6,446,937 | B1 | * | 9/2002 | Straw et al. | 254/425 |
| 6,594,924 | B2 | | 7/2003 | Curtis | |
| 6,618,965 | B1 | * | 9/2003 | Schultz et al. | 37/232 |
| 6,711,837 | B2 | | 3/2004 | Bloxdorf et al. | |
| 6,928,757 | B2 | | 8/2005 | Bloxdorf et al. | |
| 6,944,978 | B2 | | 9/2005 | LeBlond et al. | |
| 7,103,995 | B2 | * | 9/2006 | Curtis | 37/231 |
| 7,117,617 | B2 | * | 10/2006 | Kost et al. | 37/231 |
| 7,228,650 | B2 | * | 6/2007 | Curtis | 37/270 |
| 2004/0172858 | A1 | | 9/2004 | Bloxdorf et al. | |

* cited by examiner

JACK STAND FOR PLOW HITCH

BACKGROUND OF THE INVENTION

The present invention relates to snow plow hitches, and methods for mounting and demounting the hitches from vehicles.

U.S. Pat. No. 6,594,924 discloses a snow blade mount and lift assembly for a vehicle that is easily attachable and removable from the vehicle. The apparatus provides a hydraulically operated snow blade and lift assembly for a vehicle that is attached and removed from the vehicle using a self-aligning hitch mount devoid of conventional mounting pins. The self-alignment feature includes a receiver plate for mounting to the vehicle chassis and a one-piece plow assembly and lift frame readily removably coupled to the receiver plate. The plow assembly preferably includes a blade trip frame and a snow blade removably coupled to the trip frame. This snow blade hitch mount also includes a jack for lifting the assembly for proper vertical alignment with the vehicle chassis mount receiving plate.

U.S. Pat. Nos. 5,353,530; 6,711,837; 6,928,757; 6,944,978; and Re. 35,700 describe a different way of implementing a snow plow hitch assembly for a vehicle that is easily attachable and removable from the vehicle, including an integrated jack assembly.

Although the equipment and methods described in these patents represent improvements relative to previous equipment and methods, especially for use with multi-purpose vehicles owned and operated by individuals, such as pick up trucks, there is a continuing need for further simplification and ease of use, while assuring reliability and durability.

SUMMARY OF THE INVENTION

An embodiment of the invention is directed to a jack for a plow hitch assembly of the type comprising a substantially horizontal hitch frame having a front end with front end effector to mount a plow, a back end with back end effector for mounting to a vehicle, and an intermediate region between the ends. A jack assembly includes a jack tube horizontally spanning and rotationally supported in the intermediate region and a jack leg extending transversely from the jack tube, rotatable with the jack tube between a substantially vertical, deployed position and a non-vertical, retracted position. An actuator has one end attached to the jack assembly and another end forming a handle projecting above the hitch frame, for rotating the jack assembly. Means are provided for selectively rotationally securing the jack assembly to the hitch frame in (a) the deployed position, (b) a detached condition in which the jack assembly is rotatable, and (c) the retracted position. Means are also provided for selectively extending and retracting the leg relative to the tube when the jack assembly is in the deployed position.

In a configuration in which the hitch frame has spaced apart, rigid beams in the intermediate region, the jack tube preferably spans the beams. The actuator is preferably a rigid rod slidable obliquely between the beams, having one end attached to the jack assembly and another end forming a handle.

Another embodiment is directed to a method for supporting a plow hitch assembly on the ground. The hitch frame has a front end with front end effector mounted to a plow, a back end with back end effector mounted to a vehicle, and a jack assembly integral with and rotatable relative to the hitch frame between the ends. The method includes the steps of lowering the plow to the ground while the back end is mounted to the vehicle; rotating the jack assembly so a jack leg of the jack assembly projects substantially vertically toward the ground; extending the jack leg to contact the ground; rigidly supporting the extended jack leg relative to the frame; demounting the hitch frame from the vehicle; and driving the vehicle out of the hitch frame, whereby the weight of the hitch assembly is borne only by the plow and the jack leg.

According to the invention, a very simple, reliable, and effective jack assembly is integrated with a plow hitch assembly, and can be manually operated in the course of mounting or demounting a plow from a vehicle.

DETAILED DESCRIPTION OF THE INVENTION

Figure 1:
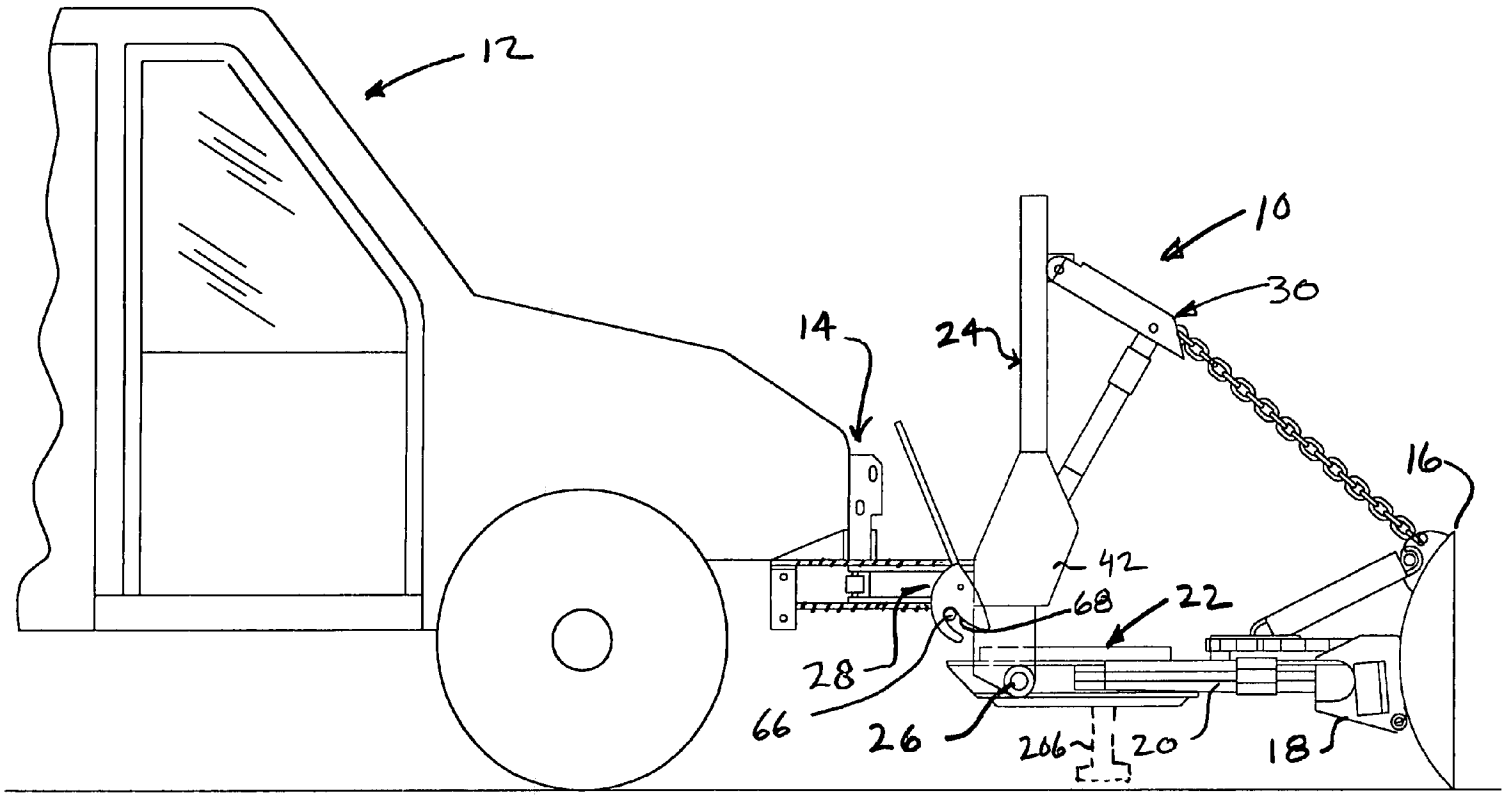
FIG. 1 is a schematic representation of the overall context of the present invention.

Turning first to FIG. 1, there is shown generally at 10 the snow blade hitch assembly in accordance with a preferred embodiment of the present invention. The vehicle 12 has a mount frame 14 attached to the vehicle the chassis (not shown) behind the front bumper by any convenient means, such as pins or bolts (not shown). The actual design of the interface for attachment to the chassis will depend upon the identity (and thus design) of the particular chassis, and is well within the skill in the art.

The mount frame 14 preferably remains permanently attached to the vehicle chassis, regardless of whether the snow blade or other accessories are in use. It is fixed and has no moving parts; its main purpose is to provide a means of attachment of the removable hitch assembly that provides the lift and angle of the snow blade 16, and to absorb and transfer any shock loads imposed on the snow blade (or other accessory) into the vehicle chassis.

In general, the hitch assembly 10 has a substantially horizontal hitch frame 22 supporting front end effector 18 for plow 16. A lift frame 24 is pivotally connected at 26 to and extends vertically from the back end of the hitch frame. The lift frame is rigidly connected to and preferably integral with the back end effector 28 which selectively engages the vehicle mount frame 14. When the hitch assembly 10 is connected to the vehicle 12, the lift frame is essentially fixed with respect to the vehicle, through the rigid relation to the back end effector 28 and the rigid connection between the back end effector 28 and the mount frame 14.

A first plow control system 30 is connected between the lift frame 24 and the front end effector 18 for raising and lowering the hitch frame 22 and plow 16 together relative to the pivot axis 26. A second plow control system 20 is connected between the hitch frame 22 and the plow blade 16, for changing the angle of the blade laterally. Further blade control may also be provided, but is not relevant to the present invention.

Figure 2:
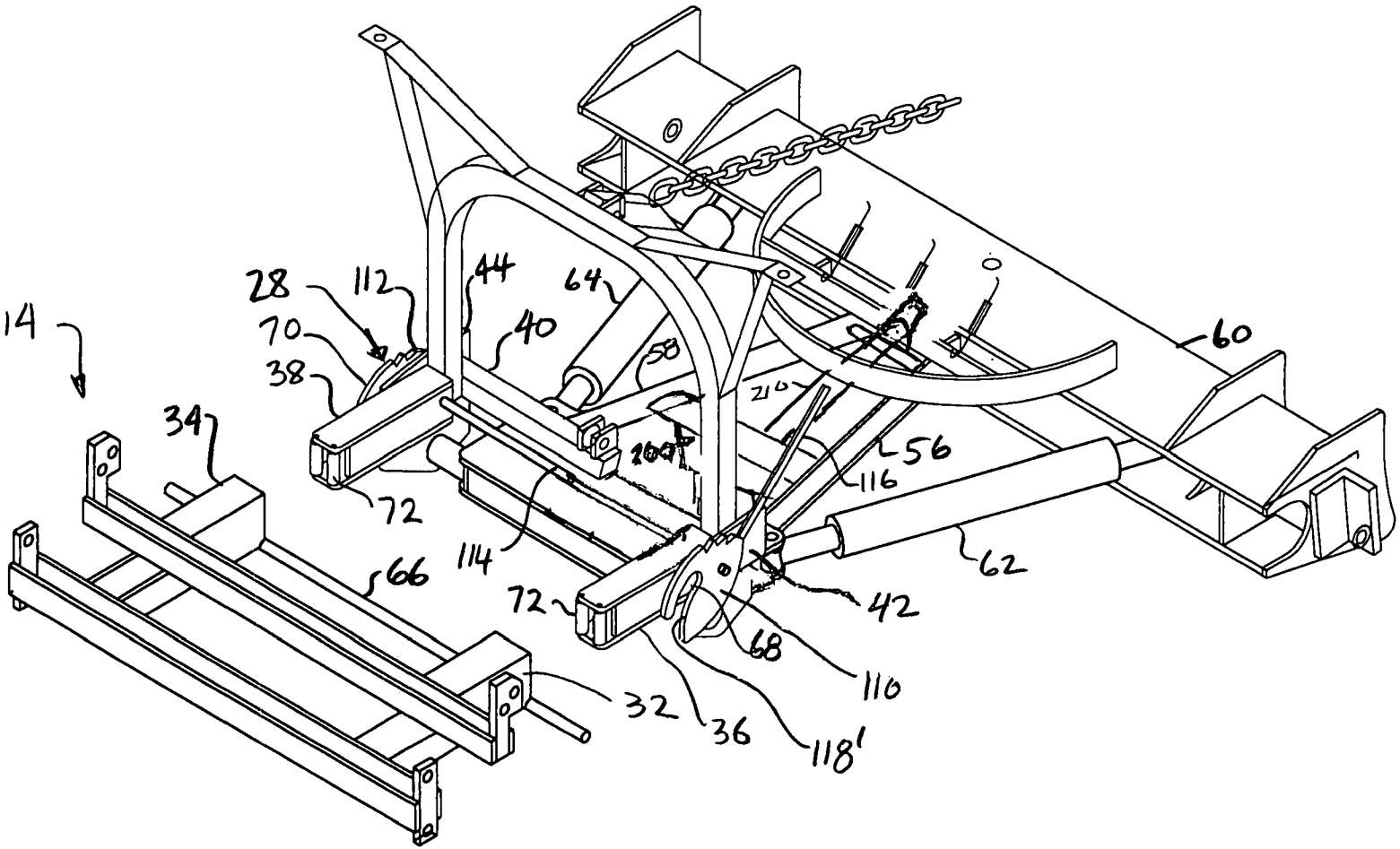
FIG. 2 is a perspective exploded rear view of the snow blade mounting system in accordance with a representative embodiment of the present invention.

With particular reference also to FIGS. 2-5, the mount frame 14 is configured as two guides and a latch bar 66, for receiving and securing mating structure on the back end effector 28. A pair of spaced side guides 32, 34 extend forward and can be rectangular as shown in FIG. 2 or they can have a tapered profile such that the distance between them decreases in the direction towards the vehicle rear. The height of each side guide 32, 34 can also taper such that it is progressively lower in the direction towards the vehicle rear. These guides can angle in and up, creating a trapezoidal wedge in both planes to provide a positive guide to the matching arms 36, 38 of the back end effector 28.

Figure 3:
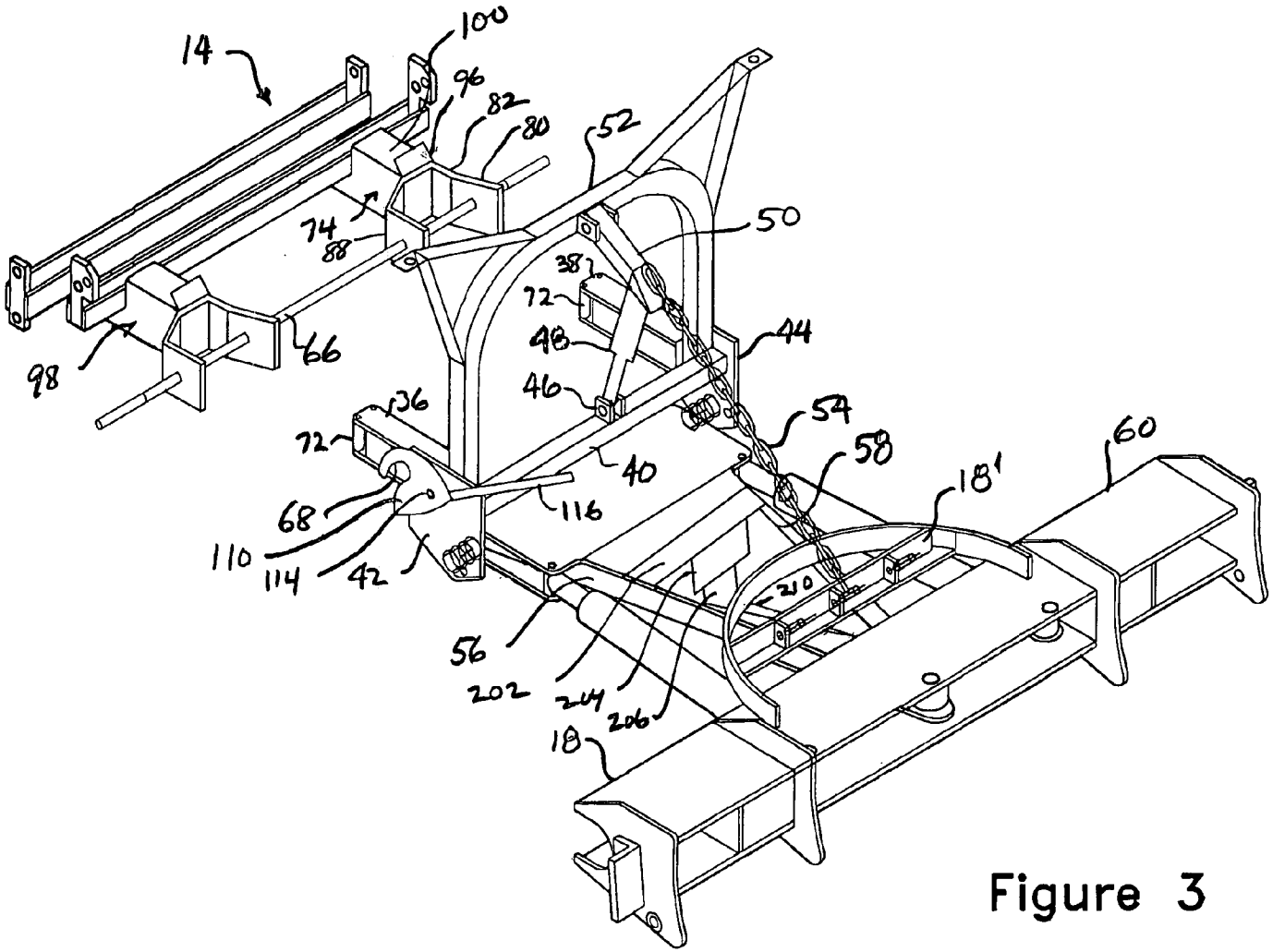
FIG. 3 is a perspective exploded front view of the snow blade mounting system in the detached condition in accordance with the embodiment of FIG. 2.
Figure 6A:
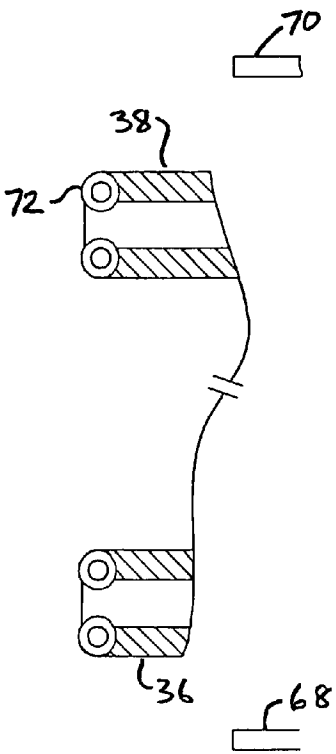
FIG. 6 is a plan view of the preferred arms forming one aspect of the back end effectors, for entering respective guides on the vehicle mount frame.
Figure 6B:
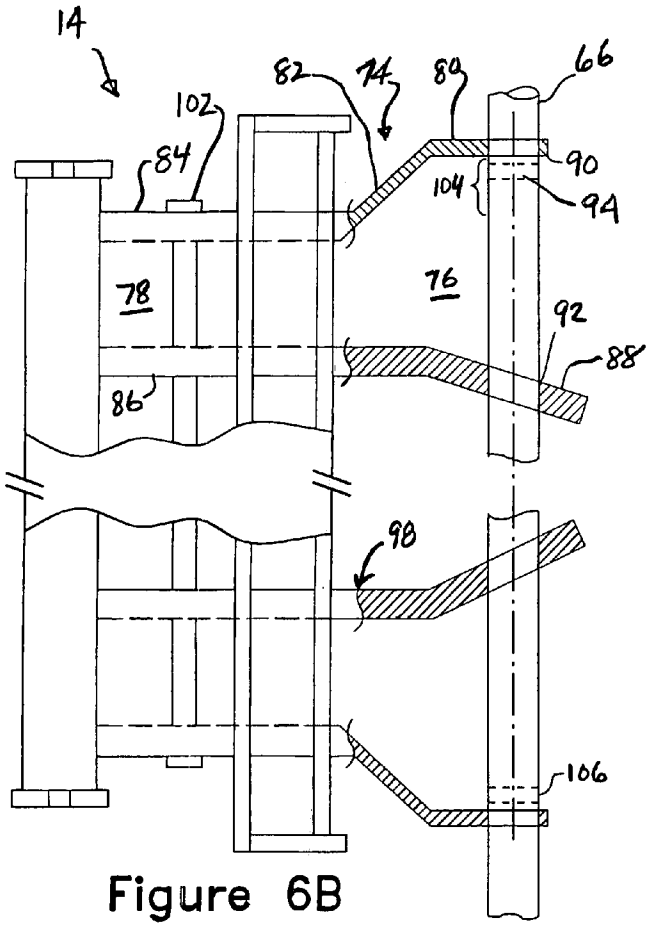
Figure 7:
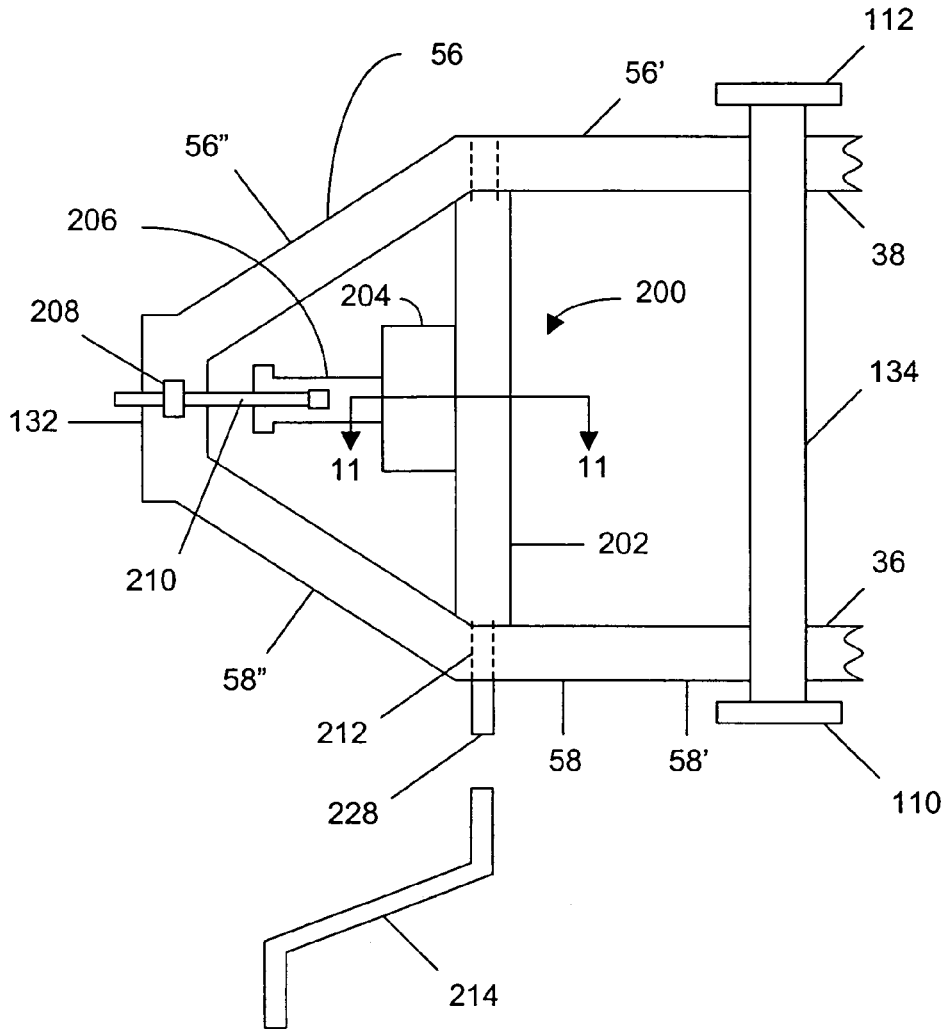
FIG. 7 is a schematic plan view of a portion of the hitch assembly including an integrated jack assembly, with the jack in the retracted position.
Figure 8:
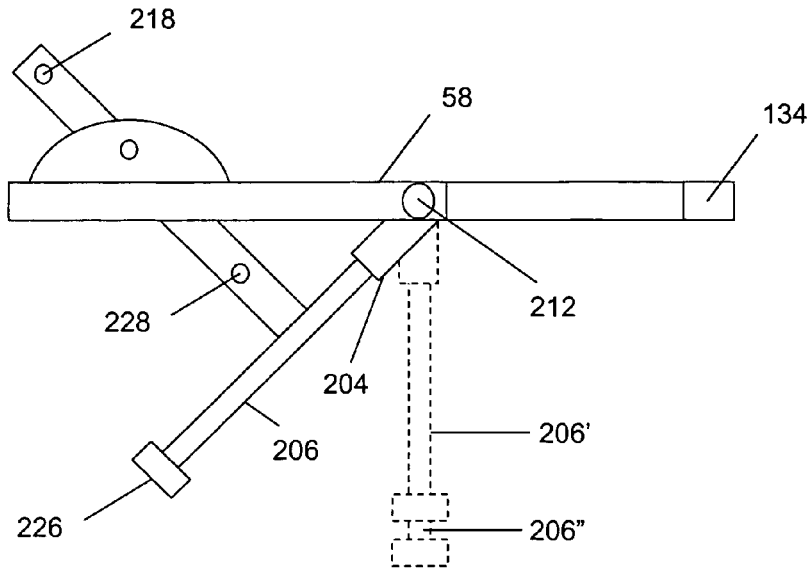
FIG. 8 is a schematic side view corresponding to FIG. 7, with the jack assembly in the deployed position.
Figure 9:
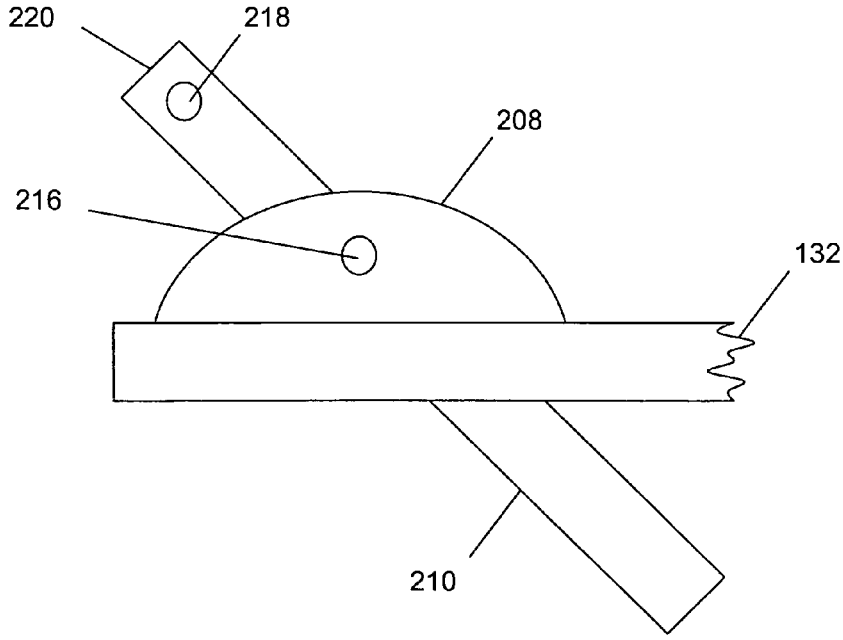
FIG. 9 is a schematic view of the jack actuating rod where attached to the frame.
Figure 10:
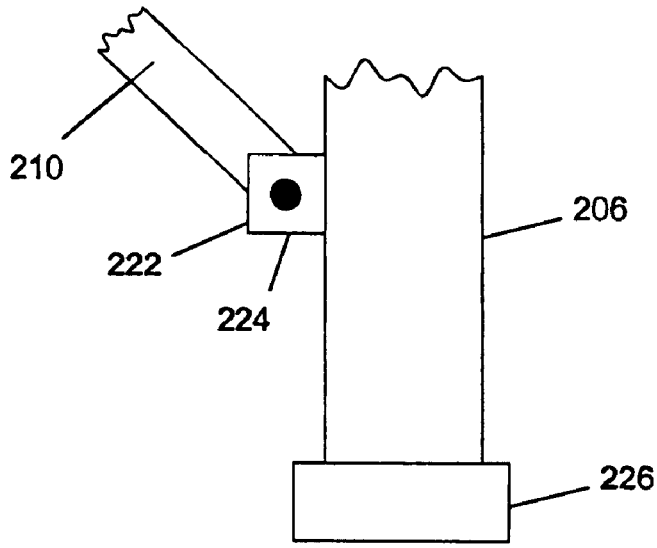
FIG. 10 is a schematic view of the jack actuating rod where attached to the leg of the jack.

Preferably, as shown in FIG. 3 and FIG. 6B, the main channels within the guides 74, 98 are rectangular and horizontal, but the entry 76 for each channel has guide surfaces that angle inwardly. In the illustrated embodiment, the latch bar 66 is below the guide channel in which the arms 36 and 38 are received. The details of this embodiment will be discussed further below.

The lift frame 24 as shown has a generally rectangular shape, although the present invention is not to be so limited. A transverse vertical actuator support tube 40 is coupled to the frame 24 between side gusset plates 42, 44 and includes a central bracket 46 for attachment of one end of a vertical lifting means 48 such as a hydraulically driven actuator or cylinder. The opposite end of the vertical lifting means 48 is coupled to pivot hood 50, which in turn is pivotally mounted to the top cross bar 52 of the lift frame. The pivot hood has means to which one operative end of a linking means such as a chain 54 or the like can be mounted. The other operative end of the linking means is mounted by any suitable means to the angle iron 18' at the front end effector or otherwise angle iron coupled to the snow plow blade. This configuration constitutes the first control system 30, whereby actuation of the vertical lifting means 48 causes a corresponding vertical lift of the hood 50, which thereby lifts the snow plow blade. Side gussets 42, 44 are shown coupled to vertical legs of the lift frame 24, such as by welding, thereby rigidly connecting the back end effectors 28 to the lift frame 24.

The hitch frame 22 is preferably an A frame structure in which the apex is at the front. This results in an intermediate region having laterally spaced apart beams 56, 58. A trip frame assembly 60 is the preferred means for attaching the snow blade to the A-frame. The trip frame 60 allows the blade to pivot forward, which allows it to trip over obstacles and absorb shock that would otherwise be transferred into the plow frame assembly and vehicle, which in extreme cases would cause substantial damage. The trip frame assembly is not required; the snow blade can articulate directly from the A-frame by directly coupling thereto via pistons and pivots.

A pair of spaced horizontal actuators such as cylinders 62,64 are each mounted at one end to the trip frame 60, and the opposite ends of each horizontal actuator are pivotally coupled to the base of the A-frame at shoulders or the like (not shown). These horizontal actuators are the operative components of the second control system 20 and are operatively connected to an actuator drive assembly (not shown).

In a conventional manner not shown in the figures, the controls for operating the first and second control systems are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift the blade, another is the unit that opens the path to lower the blade assembly. In the up position, the first solenoid opens the valve and the pump is energized, which raises the blade. In the down position, the other solenoid opens its respective valve, but the pump is not energized, which allows the blade to lower. There is a three-position hydraulic spool valve for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs. When the switch is returned to the neutral position, so does the valve.

Further details will now be provided regarding the connection of the hitch assembly 10 to the mount frame 14. The front end of the mount frame includes a single or segmented round bar 66, of a known diameter. The bar 66 extends horizontally a distance sufficient to be engaged at or near its opposite ends by a pair of opposite latch hooks 68, 70. The spacing between the guide members 32, 34 is configured to accommodate the arms 36, 38 of the hitch assembly. Each of the arms 36, 38 is preferably uniformly rectangular in section, and extends in straight, parallel relation to the other arm. Each leading end, shown in FIG. 6, preferably has a pair of vertically oriented rollers 72 at the corners, to facilitate insertion into the respective guides 32, 34. Whereas the guides 32, 34 may be trapezoidal, the arms need not match the taper and thus need not fit snugly within the guides, even when fully inserted. The guide members 32, 34 act as a track for receiving and aligning the arms 36, 38, but the arms can have some play when fully inserted.

As shown in FIGS. 3, 4, 5 and 6, the preferred relationship between each arm such as 36 and 38, with the respective guides 74, 98, will be explained in detail with respect to guide 74 with the understanding that the guide 98 is symmetric. The guide 74 has an entry or mouth 76 which is considerably larger in cross sectional area than the front of the arm 38 to be received therein. However, when the arm 38 is fully inserted into the rectangular channel 78, there is a close relationship between the rectangular envelope in the main channel portion 78 and the rectangular perimeter of the arm 38. The mouth 76 is bounded on the left by a panel 80 oriented parallel to the direction of the arm insertion and through which the latch bar 66 penetrates at 90. An angle plate 82 extends obliquely to the line of entry of arm 38 from plate 80 to the forward portion of side main side panel 84. Main sides panels 84 and 86 are parallel to the line of entry. The front portion of panel 86 has an outwardly directed panel portion 88 through which the bar 66 passes, and together with panel 80 provide a relatively large mouth 76 for initial entry of the arm 38 before being guided into the main channel 78. The rollers 72 at the front end of the arm prevent hanging up and minimize the friction during entry.

Figure 5:
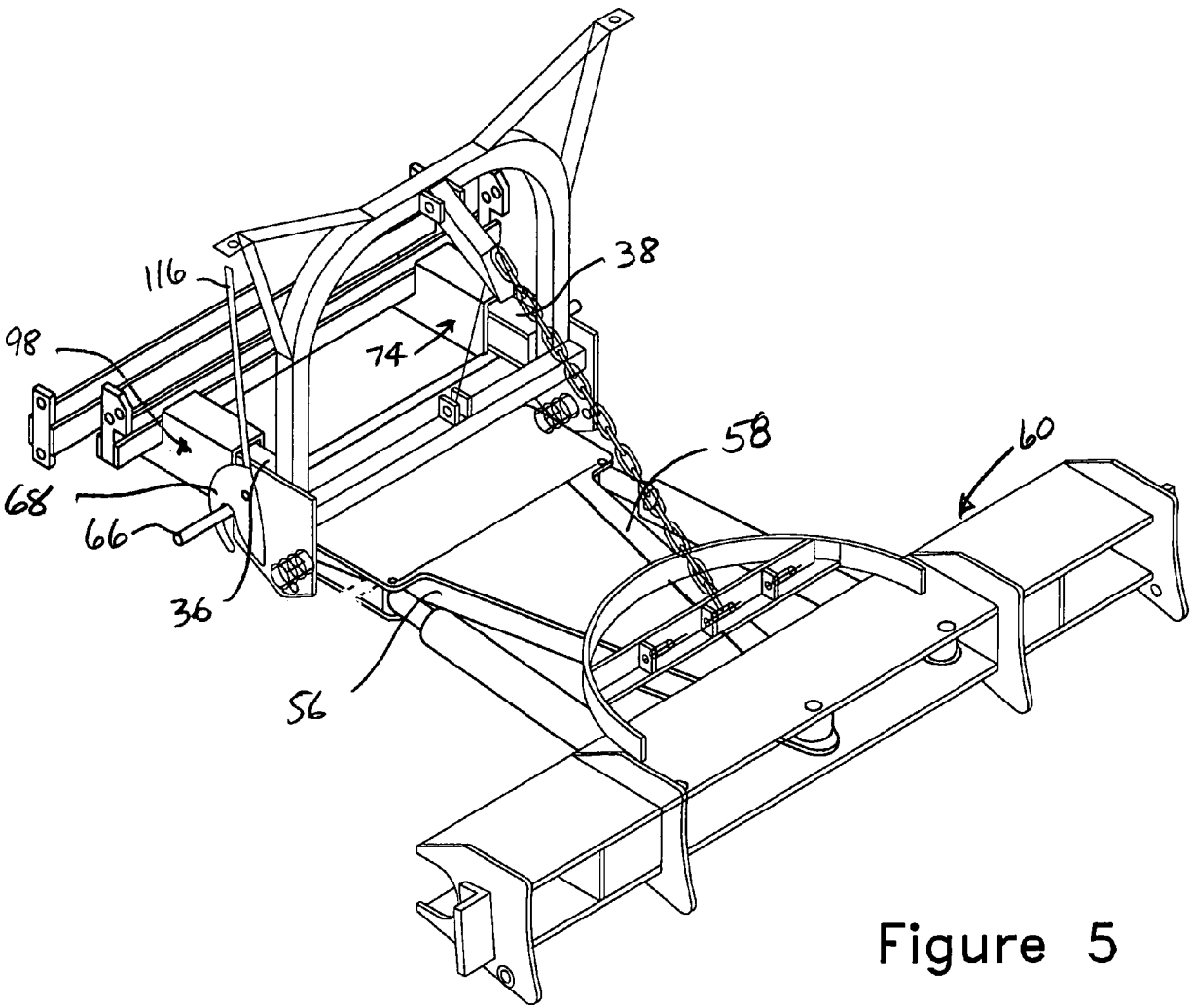
FIG. 5 is a side view of the snow blade assembly corresponding to FIG. 3, shown mounted in the attached condition in accordance with a representative embodiment of the present invention.

It can be appreciated that once the arm 38 is fully received within the main channel 78 that portion indicated as 104 of the bar will lie between the arm 38 and the panel 80. It is in this region at 94 where the latch 70 will engage the bar 66, and together with the closely conforming relation between the front portion of the arm 38 and the main channel 78, for the pair of guides 74, 98 and latches 70, 68, produces an overall rigid engagement between the hitch assembly 10 and the mounting assembly 14. Preferably, the channels 78 are open at the bottom with only the latch bar 66 and another bar 102 spanning the main channels, providing the lower contact surface for the arms. As shown in FIG. 3, the top surface 100 of the guide can be solid and the front portion can have an angle plate 96 that also can direct a slightly misaligned arm 38 toward the main channel 78. As represented in FIGS. 1 and 5, when the front end effectors 28 of the hitch frame 22 are secured to the mounting assembly 14, arm 38 is inserted within the main channel 78 of guide 74, arm 36 is fully inserted within the main channel of the other guide 98, the latch 70 is secured at 94 on bar 66, and the latch 68 is secured on bar 66 at 106.

As also shown in FIGS. 2-5, pivotally coupled to each side gusset 42, 44 via pivot shaft 108 are respective vertically oriented latched plates 110, 112. Preferably the latch plates share a common pivot shaft 114, so that movement of the two latches is coordinated. Actuation of one latch results in a corresponding movement of the other latch. In this way, the movement of the latches can be controlled by a single lever 116 coupled to one of the latch plates 110. Alternatively, separate pivot pins could be used for each latch plate, with each latch having separate means for actuation.

Each latch plate 110, 112 has a hook 68, 70 including an arcuate recess defining cam profile 118 corresponding in angle to the circumference of the bar 66. The recess is located on the plate such that in a first rotational position of the plate (FIGS. 2 and 3), the recess faces rearward, for receiving the bar 66 as the vehicle guides 32, 34 or 74, 98 fully mate with the arms 36, 38. In a second rotational position (FIGS. 4 and 5) the recess faces vertical to capture and prevent the bar 66 from moving horizontally or vertically relative to the lift frame 22.

Figure 4:
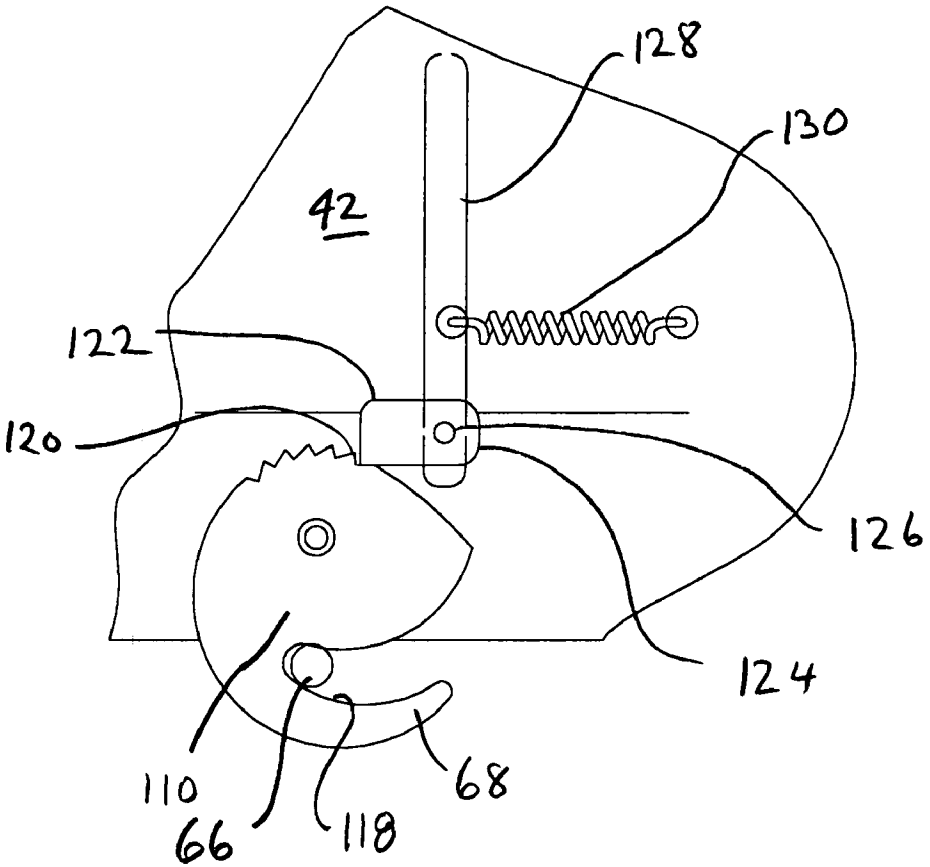
FIG. 4 is a detailed view of the latch and lock of the mounting system in accordance with a representative embodiment of the present invention.

In use for plowing, however, it is desirable that the latches 68, 70 per FIGS. 4 and 5 be locked to prevent inadvertent disengagement. For this purpose, a notch 120 is formed on a latch plate 110, preferably facing forward. A displaceable lock block 122 is supported by the lift frame 24, and biased with a nose portion into engagement with the notch to prevent rotation of the latch. The block 122 can have one end 124 pivotally mounted 126 in spaced relation to the notch, with a handle 128 accessible from the central region of the A frame, to pivot the block out of the notch against the bias of a spring 130 that extends from the gusset 42 or the like, to the handle 128. The spring biases the handle 128 clockwise in FIG. 4, and the block 122 to the left, toward to the notch. Thus, the lock handle 128 is operatively associated with the lock block 122, for selectively pulling the lock block out of the notch 120. In this manner, an operator can stand over the central region of the hitch frame 22, facing the arms 36, 38 that guide the hitch assembly 10 relative to the mount frame on the vehicle, operate the lock handle 128 to pull the block 122 out of the notch 120, and operate the latch handle 116 to rotate the latches into a first position with the recess 118 facing horizontally for receiving the bar 66.

The recess 118 has a specially contoured shape, which defines a cam profile that interacts in a planned manner with the known circumference of the bar 66. When the hitch assembly 10 is to be detached from the vehicle, the operator unlocks the lock block 122 and need not positively unlatch the latch plates 110, 112. Instead, the backing up of the vehicle causes the bar 66 to ride on the cam profile 118, thereby rotating the latch plates until the recess faces the vehicle and the bar completely disengages. Once removed from the notch 120, the lock block 122 rides smoothly on the outer surface of the latch plate 110. When the hitch assembly is to be attached to the vehicle, the recess 118 may already be facing forward (as it was when the hitch assembly was detached from the vehicle), so the vehicle merely moves the bar 66 onto the approach region 118' of the cam profile 118, which produces a moment that rotates the latch plate as the bar moves farther into the recess until a second, fully latched position is reached. Due to the bias on the lock block 122, it automatically enters the notch 120, thereby locking the latch. Of course, the latch handle 116 and the lock handle 128 can optionally be used.

The jack assembly 200 of the present invention is shown in FIGS. 1, 2, 3, and 7-11. The jack is entirely manually operated, but in a simple, reliable, and safe manner. The jack assembly 200 includes a jack tube 202 horizontally spanning and rotationally supported in the intermediate region of the hitch frame, e.g., between side beams 56, 58. A jack leg 204 extends transversely from the jack tube 202, rotatable 212 with the jack tube between a substantially vertical, deployed position and a non-vertical, retracted position. An actuator, such a rod 210, has one end 222 attached to the jack assembly and another end 220 forming a handle projecting above the hitch frame 58, for rotating the jack assembly. Means 208, 216 are provided for selectively rotationally securing or releasing the jack assembly relative to the hitch frame in (a) the deployed position 206' in FIG. 8, (b) a detached condition in which the jack assembly is rotatable, and (c) the retracted position 206 in FIG. 8. The leg 204 and tube 202 are operatively related such that the leg can be extended 206 relative to the tube when the jack assembly is in the deployed position (206" in FIG. 8). The actuator is a rigid rod slidable obliquely between the beams, having one end attached to the jack assembly and another end forming said handle.

Preferably, the actuator rod 210 is situated adjacent the apex 132 of the A-frame and the jack leg 204 in the retracted position fits within the converging sides 56", 58" of the A-frame. The rigid rod passes through a cleat 208 on the hitch frame, and defines one of many equivalent means for selectively rotationally securing the jack assembly in either of the retracted or deployed positions. For example, the cleat can have a pair of opposed holes for mating with holes on the rod, such that a pin 216 can be passed through a selected hole 218, 228 in on the rod.

Figure 11:
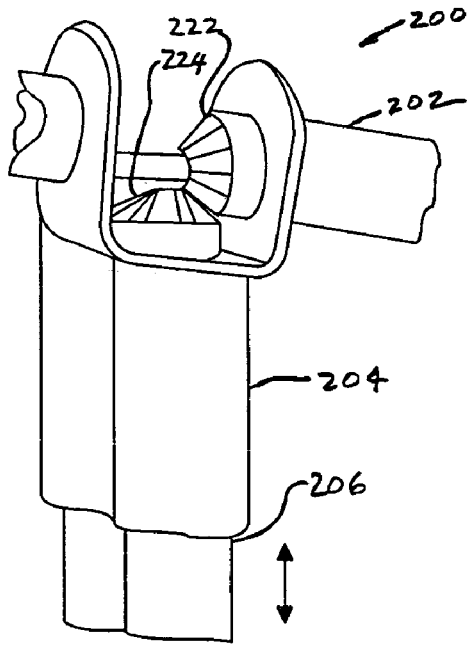
FIG. 11 is a section view of the jackscrew for extending and retracting the jack leg.

The leg 204 is preferable extended or retracted by a jack screw or similar mechanism interposed between the tube 202 and a lift platform 206 or similar mechanism within leg 204. A socket 228 at one end of the tube 202, is operatively connected to the jack screw, for receiving a crank 214 to selectively expand or contract the lift platform and thereby adjust the length of the extension 206 of the leg from the tube. In FIG. 11, the cover for the jack screw gearing has been omitted to reveal orthogonal mating gears 222 and 224. Gear 224 rotates a worm gear or the like (not shown) operatively coupling the lift platform 206 to the leg 204 in any manner that would be well within the skill of an ordinary mechanic, for vertical extension or retraction. Thus, the crank rotates first gear 222 on a first shaft in tube 202 about a first, horizontal axis; the first gear 222 rotates mating second gear 224 on a second shaft in leg 204 about a second, perpendicular (e.g., vertical) axis; and the second shaft is operatively coupled to the pedestal 206 for linear movement within leg 204 along the second axis.

Thus, the integrated jack assembly 200 is operable according to a method for supporting a plow hitch assembly 10 on the ground, by lowering the plow 16 to the ground while the back end 28 is mounted to the vehicle, rotating the jack assembly 200 so a jack leg 206 of the jack assembly projects substantially vertically toward the ground, extending the jack leg 206 to contact the ground, rigidly supporting the extended jack leg relative to the frame 22, demounting the hitch frame 22 from the vehicle, and driving the vehicle out of the hitch frame, whereby the weight of the hitch assembly is borne only by the plow 18 and the jack leg 206.

A more specific method according to the invention includes, lowering the plow 16 to the ground while the back end 28 is mounted to the vehicle, then rotating the jack assembly so a jack leg 206 of the jack assembly projects substantially vertically toward the ground. The jack leg is extended to contact the ground, and then fixtured 208, 216 for rigidly supporting the extended jack leg relative to the frame. The operator then moves the lock handle 128 to disengage the block 122 from the notch 120. He then drives the vehicle out of the hitch frame 22, whereby the bar 66 moves with the vehicle and rides on the cam profile 118 to rotate the latch plate 110 so the recess opens toward the vehicle and the bar is drawn out of the latch and the weight of the hitch assembly is borne only by the plow and the jack leg.

The steps of attaching a plow hitch assembly 10 to a vehicle, include pulling the lock block 122 out of the notch 120, and optionally rotating the latch 116 handle to point the recess 118 toward the vehicle. If the arms 36, 38 extending from the hitch assembly 22 are not within the range of capture by the guides 32, 34 or 74, 98 on the mount frame 14 of the vehicle, the jack can be operated to vertically align these structures. The operator drives the vehicle toward the back end 28 of the hitch assembly 22, whereby the bar 66 moves with the vehicle and rides on the cam profile 118 to rotate the latch plate 110 so the recess opens substantially vertically to capture the bar, with the notch 120 contacting and receiving the lock block 122. The jack leg 206 is contracted, off the ground, whereby the weight of the hitch assembly 10 is borne substantially only by the plow. The jack assembly 200 is rotated toward the hitch assembly 22 and secured in the retracted position.

In operation, the vehicle is positioned close to the hitch assembly 22, and the jack mechanism 200 is operated so that the lift assembly 24 is raised or lowered depending upon the height of the arms. Once the proper height is achieved (as determined by visual inspection), the vehicle is driven towards the arms. At this point the latches 68, 70 are in the unlatched position shown in FIGS. 2 and 3, configured to grasp and engage the bar 66. Once the bar 66 is positioned in the recesses 118 of the latches, the handle 116 is used to fully draw the latches around the bar and the latches are locked by the separate and distinct mechanism 122, as shown in FIGS. 4 and 5. The lift assembly is now locked to the vehicle chassis. The jack is then contracted and rotated substantially parallel with the A-frame where it is stowed during use of the plow.

FIGS. 12-15 show another embodiment of hitch assembly 300 with associated jack. In the orientation as shown, the front end 302 is connectable to the plow and the back end 304 is connectable to the vehicle. The hitch frame 306 is pivotally connected to lift frame 308, at 310. The hitch frame is formed by two spaced apart rigid beams 312, 314 that converge to an apex 316 at the front and are spanned by a rigid cross beam 318 at the back. In an intermediate region between the front and back ends of the spaced apart beams, a box frame having generally opposed, rigid walls 320, 322 overlies respective portions of the spaced beams. The box preferably is directly supported by the beams, and extends vertically above the beams. A jack tube 324 horizontally spans and is rotationally supported by the box frame walls. A jack leg 326 extends transversely from the jack tube, rotatable with the jack tube between a retracted position substantially between the box frame walls 320, 322 and a deployed position substantially vertical below the jack tube. An elongated, rigid actuator 328 is slidable obliquely between the box frame walls 320, 322 and between the spaced beams 312, 314, having one end 330 pivotally attached to the jack leg 326 and another end 332 projecting above the box frame walls.

Figure 14:
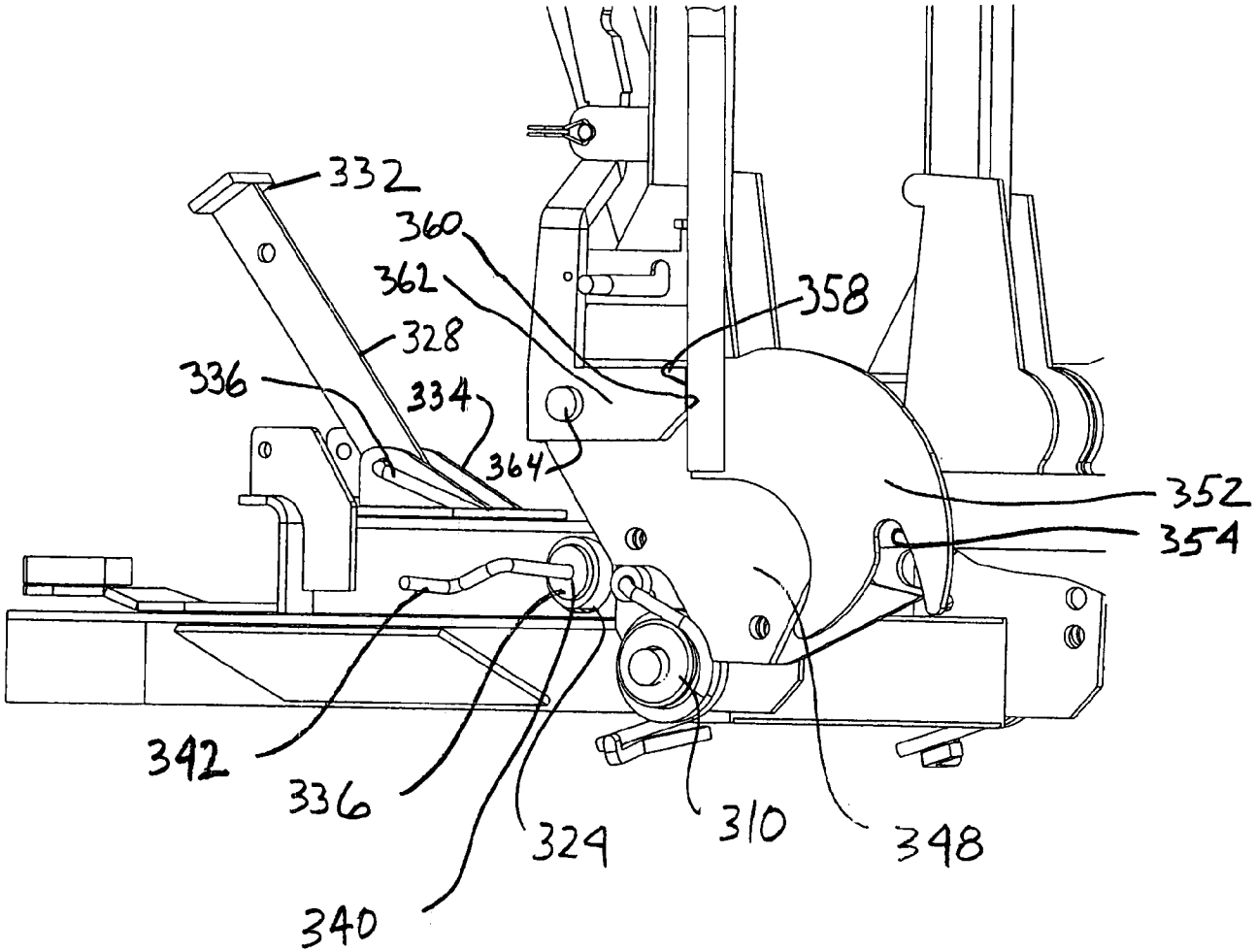
FIG. 14 is a detailed view of the latch and jack of the embodiment shown in FIG. 13, with the jack in the retracted position and the latch in the locked position.
Figure 15:
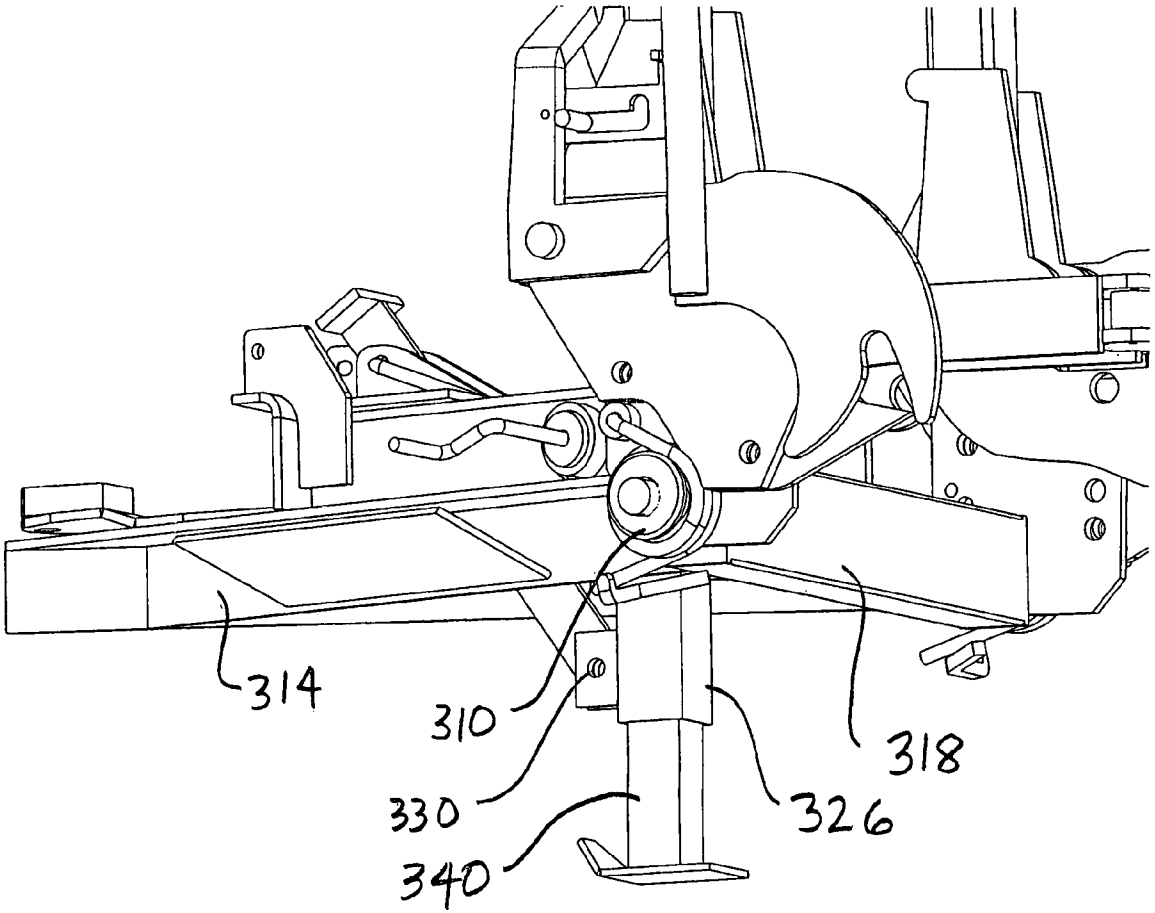
FIG. 15 is a detailed view of the latch and jack of FIG. 14, with the jack in the deployed position.

A bracket 334 with associated pins 336, or a clevis, bolt, or other means, is carried by and preferably rigidly connected to the box frame adjacent the front end 302 of the hitch frame, with the actuator 328 slidable through or along the bracket. The actuator can thus be selectively attached to or otherwise cooperate with the bracket 334, in (a) a first, retracted holding position, attached intermediate the ends of the actuator in which the actuator holds the jack leg in said retracted position (FIG. 14), (b) a second, detached, actuating position in which the actuator is slidable between the box frame walls and between the spaced beams to rotate the tube, and (c) a third, deployed holding position attached closer to said other end of the actuator in which the actuator holds the jack leg in the deployed position (FIG. 15). A jackscrew 336 passes through the jack tube 324 and is operatively connected to a lift platform 338 extendable within the leg. A socket 340 is present at one end of the tube, operatively connected to the jackscrew 336, for cooperating with a crank 342 to selectively expand or contract the lift platform and thereby adjust the length of the extension of the leg from the tube.

Figure 12:
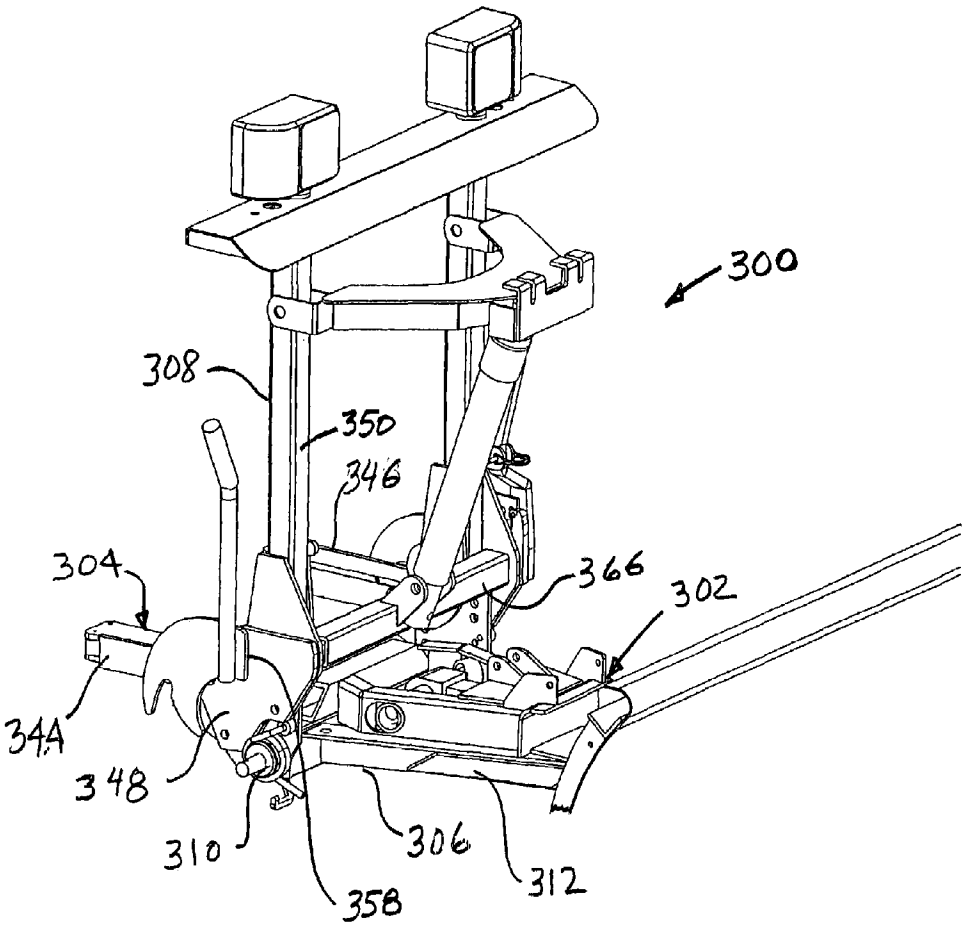
FIG. 12 is a view of the preferred embodiment, corresponding to and oriented in the same direction as the view of FIG. 3.
Figure 13:
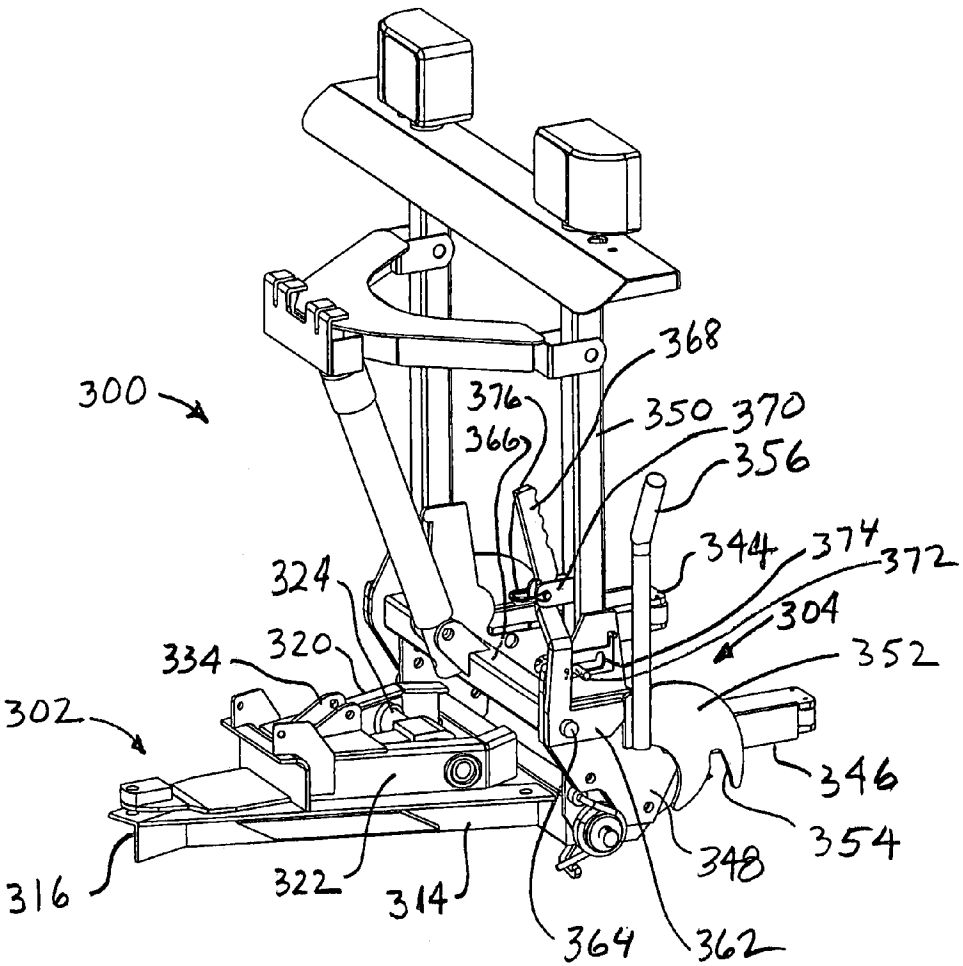
FIG. 13 is a view of the preferred embodiment, in reverse orientation to the view of FIG. 12.

The back end 304 of the hitch assembly 300 is shown in FIGS. 12 and 13 with the mounting arms 344, 346 rigidly extending from the lift platform 308. In FIGS. 14 and 15, the arms have been omitted for clarity. The arms are preferably distinct members that are bolted to respective gusset plates 348 or the like which are in turn welded or bolted to respective, laterally spaced, vertically extending posts 350. The preferred form of the arms 344, 346 and the relationship to the mounting frame on the vehicle are as described above with respect to FIGS. 1-6. However, in the embodiment of FIGS. 12-15, the latch plate and lock block configuration are somewhat different.

Each latch plate 352 is pivotally mounted to a respective gusset plate 348, and has a cammed recess 354 at one end for engaging the bar of the mounting frame, as previously described. The latch handle 356 is attached to the opposite end of the latch plate, for implementing or completing the pivoting action. Also at the opposite end, a lock stop surface 358 on the plate 352 or handle 354, is preferably oriented in substantially the same direction as the handle axis, i.e., preferably substantially vertically when the handle and latch plate are in the fully latched position as shown in FIGS. 12-15. This stop surface 358 is analogous to a notch, in that it defines a sharp change in direction or discontinuity of the curvature of the edge of the latch plate, remote from the recess 354. The important characteristic is that the stop surface is shaped and oriented to abut the face 360 of lock block 362 when the plate is latched to the mounting frame bar and the lock block is in the lock position shown in FIGS. 12-15.

The lock block 362 can be pivotally mounted at 364 to the gusset plate 352 or the lift frame cross member 366, to which the gusset plate may be rigidly attached. The locking handle 368 is attached to and extends upwardly from the lock block, and can pass through a guide or the like 370 attached to post 350, for keeping the handle within the bounds of permitted movement. Alternatively, the handle is pivotally connected to the guide or the like 370, nearer the end to be grasped.

It can be appreciated that in the limit of the counterclockwise pivoting of the lock handle 368 as shown in FIG. 13, lock block 362 abuts the latch plate stop surface 358 and prevents pivoting of the latch plate out of full engagement and trapping of the mounting bar. In the limit of clockwise pivoting of the lock handle, the lock block would be pulled away from the latch plate 352 and permit counterclockwise pivoting of the latch handle 356 and latch plate 352, until the latch handle is substantially horizontal at 9:00 o'clock and the recess 354 is open for receiving or releasing the bar at 3:00 o'clock. To facilitate this extent of pivoting, the latch handle 356 and the lock handle 368 are offset in the width direction of the hitch assembly.

Means are preferably provided for assuring that the lock block 362 remains in abutting relation with the stop surface 358 of the latch plate when the latch plate is in the latched position (i.e., recess 354 is substantially vertical). The lock block 362 or handle 368 is preferably biased, for example by spring 372 acting between the handle 368 and an anchor 374 on the lift frame.

Another option is a mechanical restraint. For example, in the configuration shown in FIG. 13, the guide 370 can have an open front that is selectively opened and closed by a pin and loop 376. When open, the handle can be pulled away from the guide, bent slightly to out of alignment with the guide, and have full freedom to rotate about pivot 364. After the handle is returned within the guide for locking the latch plate, the loop is re-pinned to trap the handle within the guide.

In yet another alternative, pivot 364 is an axle that runs through cross member 366, to a lock block associated with the other latch plate, for simultaneous pivoting by a single lock handle 368. Similarly, one latch handle 356 could be coupled to the other latch plate, for simultaneous pivoting. Preferably, the latch handle 356 and the lock handle 368 extend side-by-side in the latched and locked condition of the latch plates, so that an operator can straddle the hitch assembly on either side of the beams 312, 314 and easily pivot the lock handle clockwise and the latch handle counterclockwise during the process of disengaging the hitch assembly 300 from the vehicle mounting assembly.

The invention claimed is:

1. A plow hitch assembly, comprising:

a substantially horizontal hitch frame having a front end with front end effector to mount a plow, a back end with back end effector for mounting to a vehicle, and an intermediate region having spaced apart, rigid beams;

a jack tube horizontally spanning and rotationally supported by the rigid beams;

a jack leg rigidly connected to the jack tube by a substantially U-shaped yoke and extending transversely from the jack tube, rotatable with said jack tube between a retracted position substantially between the beams and a deployed position substantially vertical below the jack tube;

an elongated, rigid actuator slidable obliquely between the beams, having one end attached to the jack leg and another end projecting above the hitch frame adjacent the front end of the hitch frame;

means carried by the hitch frame adjacent the front end of the hitch frame for selective attachment to the actuator in (a) a first, retracted holding position, attached intermediate the ends of the actuator in which the actuator holds the jack leg in said retracted position, (b) a second, detached, actuating position in which the actuator is slidable between the beams to rotate the tube, and (c) a third, deployed holding position attached closer to said other end of the actuator in which the actuator holds the jack leg in the deployed position; and a jack screw having orthogonally mating gears within the yoke operatively coupled to an expandable lift platform interposed between the tube and the leg; and a socket at one end of the tube, operatively connected to a shaft of one of said gears of the jack screw, which shaft is disposed in said tube, for receiving a crank to selectively expand or contract said lift platform and thereby adjust the length of the extension of said leg from said tube.

2. The hitch assembly of claim 1, wherein a lift frame for raising and lowering the plow extends vertically from the back end of the beams; and the jack tube spans the beams forward of the lift frame.

3. The hitch assembly of claim 1, wherein the back end effectors include two substantially parallel, spaced arms extending from the hitch frame for mating with respective spaced guides on the vehicle, and two spaced latches for engaging a latch bar on the vehicle;

a latch handle extends above the hitch frame, and is operatively associated with each latch; and the jack tube spans the beams forward of the handle.

4. The hitch assembly of claim 1, wherein the hitch frame is an A-frame and said beams constitute the converging sides of the A-frame;

the actuator is situated adjacent the apex of the A-frame; and the jack leg in the retracted position fits within the converging sides of the A-frame.

5. The hitch assembly of claim 1, wherein the actuator is a rod having two spaced apart through holes; and said rod passes through a cleat on the hitch frame defining said means for selective attachment to the actuator, said cleat having a pair of through holes alignable with the holes on the rod and a pin for selective attachment of the rod to the cleat in either of said first or third positions, respectively.

* * * * *